US005943881A

United States Patent [19]

Grenier

[11] Patent Number: 5,943,881

[45] Date of Patent: Aug. 31, 1999

[54] COOLING PROCESS AND INSTALLATION, IN PARTICULAR FOR THE LIQUEFACTION OF NATURAL GAS

[75] Inventor: Maurice Grenier, Paris, France

[73] Assignee: GAZ de France (G.D.F.) Service National, Paris, France

[21] Appl. No.: 08/891,133

[22] Filed: Jul. 10, 1997

[30] Foreign Application Priority Data

Jul. 12, 1996 [FR] France ..... 96 08758

[51] Int. Cl.[6] ..... F25J 3/00

[52] U.S. Cl. ..... 62/612; 62/613; 62/912; 62/913

[58] Field of Search ..... 62/612, 613, 912, 62/913

[56] References Cited

U.S. PATENT DOCUMENTS

| | | | |
|---|---|---|---|
| 4,251,247 | 2/1981 | Gauberthier et al. | 62/612 |
| 4,274,849 | 6/1981 | Garier et al. | 62/612 |
| 4,325,231 | 4/1982 | Krieger | 62/612 X |
| 4,339,253 | 7/1982 | Caetani et al. | 62/612 |
| 4,586,942 | 5/1986 | Gauthier . | |
| 4,755,200 | 7/1988 | Liu et al. | 62/612 |
| 5,535,594 | 7/1996 | Grenier . | |

FOREIGN PATENT DOCUMENTS

| | | |
|---|---|---|
| 0117793 | 9/1984 | European Pat. Off. . |
| 197 22 490 C1 | 7/1998 | Germany . |
| 94 24500 | 10/1994 | WIPO . |

*Primary Examiner*—Christopher B. Kilner
*Attorney, Agent, or Firm*—Rothwell, Figg, Ernst & Kurz, p.c.

[57] ABSTRACT

A refrigerating mixture is compressed in the penultimate stage of a plurality of stages of a compression unit. The mixture is partially condensed in order to cool it substantially to ambient temperature; the condensed mixture is separated in order to obtain a vapour fraction and a liquid fraction; the vapour fraction is cooled and partially condensed; the resultant vapour fraction is sent to the final compression stage at least the high pressure vapour fraction and the liquid fraction are cooled, expanded, and circulated in at least first heat exchange means (5) with the fluid to be cooled.

Moreover, according to the invention, during condensation of the vapour fraction, the vapour fraction produced by separating the condensed mixture is cooled by circulating it in heat-exchange relationship with a refrigerating fluid, in second heat exchange means.

35 Claims, 7 Drawing Sheets

Figure 1:
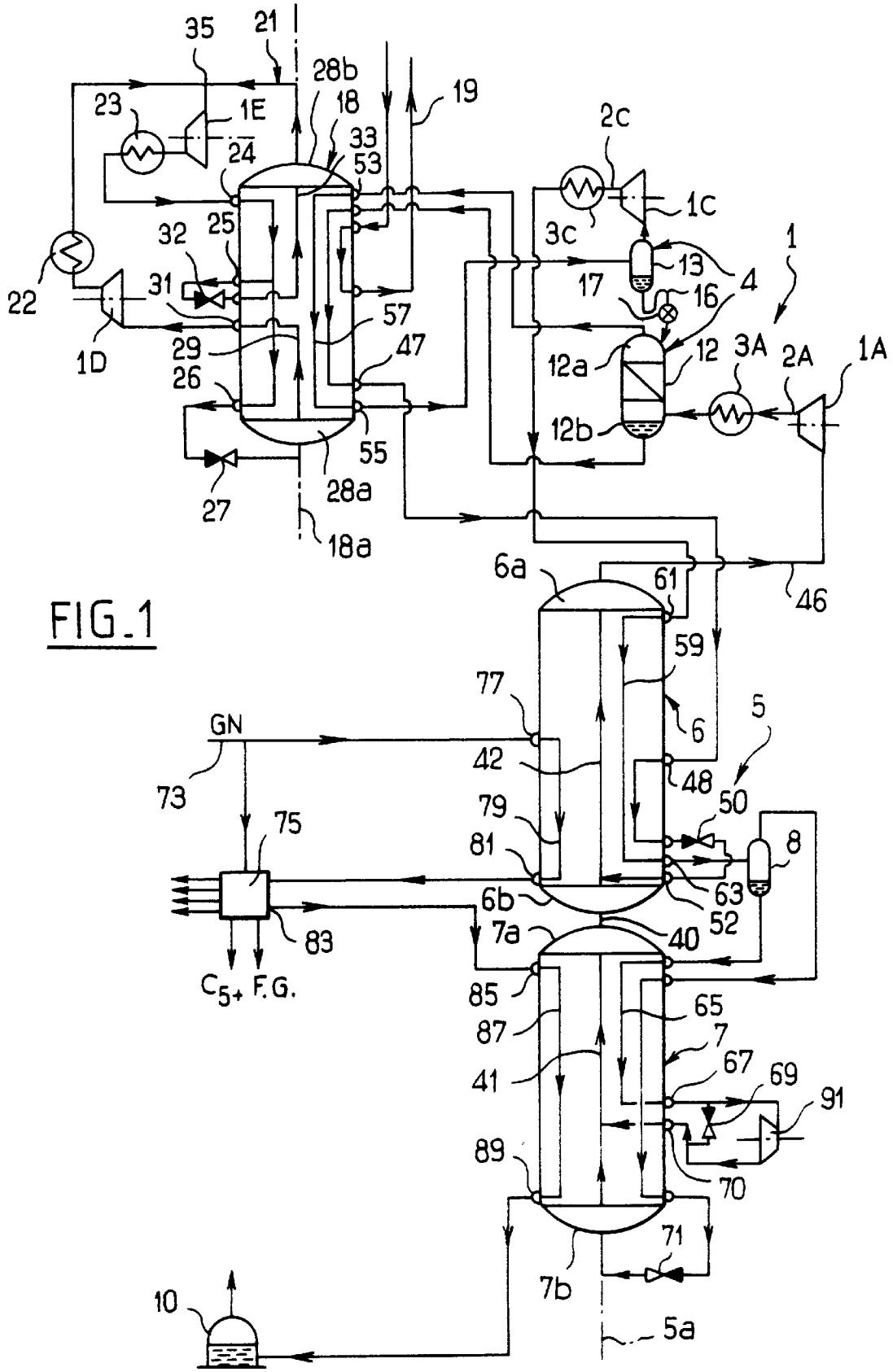

19
23
1E
28b
21
33
2C
1C
25
3C
13
32
22
17
16
4
1'
57
3B
1E
31
46
12
1B
29
12a
2B
155
26
3A
1A
55
12C
27
18
157
2A
46
6a 42
61
6
77
GN
5
73
48
50
75
79
8
6b
40
7a
C5+ F.G.
85
65
87
7
41
69
89
10
7b
71
GNL

COOLING PROCESS AND INSTALLATION, IN PARTICULAR FOR THE LIQUEFACTION OF NATURAL GAS

The present invention relates to the cooling of fluids and applies in particular to the liquefaction of natural gas.

Within this framework, the invention first of all concerns a process in which:

a) a refrigerating mixture which may be composed of constituents of different degrees of volatility is compressed in a penultimate stage of a plurality of stages of a compression unit, b) the refrigerating mixture thus compressed is partially condensed by cooling, c) the condensed refrigerating mixture is separated in order to obtain a vapour fraction and a liquid fraction, d) the said vapour fraction is cooled while bringing about partial condensation, e) the resultant vapour fraction is sent to the final compression stage in order to obtain a high pressure vapour fraction, f) at least certain of the said high pressure vapour fraction and liquid fraction are cooled, expanded and circulated in at least a first heat exchange unit in indirect heat exchange with the fluid to be cooled.

Such a manner of proceeding is known.

Thus, WOA-94 24500 (which is included in the present description by reference), describes such a process in which a refrigerating mixture composed of constituents of different degrees of volatility is compressed in at least two stages, in an installation of the integral incorporated cascade type, and, after at least each of the intermediate compression stages (that is to say, stages preceding the final high pressure stage) the refrigerating mixture is partially condensed, at least certain of the condensed fractions as well as the high pressure gaseous fraction being cooled, relieved of pressure (or expanded) and placed in a heat exchange relationship with the fluid to be cooled, then compressed again, the gas derived from the penultimate compression stage being moreover distilled in a distillation apparatus, the head of which is cooled with a liquid having a temperature below a temperature termed "reference" or "ambient" temperature, in order to form on the one hand the liquid condensate of the penultimate compression stage and, on the other hand, a vapour phase which is sent to the final compression stage.

Preferably, that same publication provides for cooling and partially condensing the head vapour of the distillation apparatus, by heat exchange (in a heat exchange unit with two plate exchangers arranged in series) with at least the said pressure-relieved fractions, in order to obtain a vapour phase and a liquid phase, and for cooling the head of the distillation apparatus with the liquid phase 10 thus obtained, the vapour phase constituting the said phase which is sent to the final compression stage.

It will be noted that in the present description, as in WO-A-94 24500, the pressures in question are absolute pressures.

Moreover, the refrigerating mixture already mentioned should be considered as constituted of a certain number of fluids including, among others, nitrogen and hydrocarbons such as methane, ethylene, ethane, propane, butane, pentane, etc.

The "ambient temperature" will moreover be defined as the thermodynamic reference temperature corresponding to the temperature of the cooling fluid (in particular water or air) available on the site where the process is used and employed in the cycle, increased by the temperature deviation which is fixed, by construction, at the outlet of the cooling apparatus of the installation (compressor, exchanger . . .). In practice, this deviation will be approximately 1° C. to 20° C., and preferably of the order of 3° C. to 15° C.

It will also be noted henceforth that if a distillation apparatus is used, it will be of advantage to cool its head with a fluid (liquid) such that:

the said fluid (liquid) intended for cooling the head is itself cooled to a temperature below the said "reference"or "ambient" temperature (or even lower than the temperature of the cooling fluid used on site in the exchangers), and that the temperature difference between the "ambient" temperature and the temperature of the fluid (liquid) intended for cooling the head of the distilling means is between approximately 20° C. and 55° C., and typically from 30° C. to 45° C.

Typically, the temperature of the cooling fluid available on site (air, sea water or river water..) will be between approximately −20° C. and +45° C.

Although the process and installation of WO-A-94 24500 are of interest, it has however proved that it is still possible to obtain a saving in overall mechanical energy used for the desired cooling and to improve the thermodynamic efficiency of this cooling operation, more particularly if it is a question of liquefying natural gas, with a potentially improved reliability and economy of installation.

The solution proposed in the invention in order tend towards these objectives is, during the aforesaid step d), to cool the vapour fraction derived from the separation of the condensed refrigerating mixture, by circulating this vapour fraction in (indirect) heat exchange with a refrigerating fluid, in a second heat exchange unit.

The mechanical energy necessary for the functioning of this second "refrigerating group" should, according to calculations, be less than 10% of the total mechanical energy necessary for the whole of the installation, this making it possible for example to drive the second group by means of an electric motor from the starting motor of the gas turbine of the unit for compression of the refriger-ating mixture, then used as a generator.

Moreover, with such a process applied to the liquefaction of natural gas, the production of liquefied natural gas could be increased by more than 10% compared with the solution with two compression stages of WO-A-94 24500.

Owing to the addition of a second refrigerating group, compared with the solution of WO-A-94 24500, the investment cost for equipment for a given production of LNG will probably be increased. However, the saving in pipework may be not inconsiderable.

It should also be noted that the technology of the hot exchanger of the first refrigerating group is also simplified. The invention in fact makes it possible to relieve a portion of the said "first heat exchange unit" partially from their thermal work, this allowing other elements of the cyde to be optimised.

If a distillation column is used, a first optimisation of the cooling of its head will moreover be possible, in comparison with what is provided for in WO-A-94 24500.

For this it is recommended, during the aforesaid steps c), d) and e):

to separate the (partially) condensed mixture in the said distillation apparatus, to condense (again in part) in the said second heat exchange unit the vapour fraction derived from the distillation apparatus, in order to obtain a condensed vapour fraction, to pass the condensed vapour fraction into a separator in order to obtain a vapour fraction and a liquid fraction, to send the vapour fraction derived from the separator into the final compression stage, and to return the liquid fraction derived from the said separator into the head of the column of the distillation apparatus, in order to cool it.

It should be noted that in place of the distillation apparatus, another separator may be used.

In this case:

the said condensed vapour fraction is passed into a second separator in order to obtain a vapour fraction and a liquid fraction, the vapour fraction derived from the second separator is sent into the final compression stage, and the liquid fraction derived from the second separator is sent to the said first heat exchange unit.

Preferably, in one case as in the other, it is further recommended:

to circulate the liquid fraction derived from step c) into the second heat exchange unit, substantially between the hot and cold ends of the unit, and to admit the liquid fraction thus cooled into an intermediate part of a first, hot, exchanger of two heat exchangers arranged in series, one hot and the other cold, belonging to the said first heat exchange unit.

In addition to the above, the process of the invention may moreover comprise one or more of the following characteristics:

outside the second heat exchange unit, the refrigerating fluid is circulated in a closed circuit refrigeration cycle, either with a single compression stage, or with two successive compression stages, with, at the outlet of the final cooler (23 in FIG. 1), total condensation of the refrigerating fluid;

if the fluid to be cooled is natural gas, before admitting the natural gas into the said first heat exchange unit, it is circulated first in the said "second heat exchange unit" and, before or after it is circulated in this second unit, the natural gas is passed into a drying unit;

during the aforesaid step f), the high pressure vapour fraction is cooled after the final compression stage, and it is circulated in the said second heat exchange unit in order to cool it further by heat exchange with the refrigerating fluid before sending it into the first heat exchange unit, at the outlet of the final compression stage of the said compression unit, the high pressure vapour fraction is cooled and it is sent into an intermediate inlet of a first, hot, exchanger, of two exchangers arranged in series, one hot and the other cold, constituting the said first heat exchange unit;

between the above-mentioned steps b) and c), the condensed mixture is circulated in the second heat exchange unit;

a heat exchanging fluid is circulated in isolation in the second heat exchange unit;

assuming that the gas to be cooled is natural gas, before circulating the natural gas in the first heat exchange unit, it is subjected to drying, and, after drying, the dry natural gas is passed inside the first heat exchange unit, firstly into a first part of a first, hot, exchanger of two exchangers arranged in series, one hot and the other cold, constituting the said first heat exchange unit, then into a part of the said second exchanger of the first heat exchange unit, before passing into a fractionating unit outside the said first heat exchange unit.

It should further be noted that the aforesaid step b) could optionally be omitted so that there was no refrigerating apparatus between the outlet of the compressor of the penultimate stage and the inlet of the separating apparatus (in particular distilling means), and that thus the compressed refrigerating mixture is not condensed before separating it in step c). Thus the process will then be carried out in accordance with claim 18 hereinafter, on the basis then of the prior art EP-A 117 793 with, in such a case, circulation of the liquid fraction (issued from the separation of the compressed mixture) in heat exchange means (referenced 4A, 10 in EP-A-117 793) independent from said <<first heat exchange means>> (referenced 11, 15 in EP-A-117 793) before said liquid fraction circulates into said first exchange means.

A further object of the invention is a cooling installation, in particular for the liquefaction of natural gas, which can be used for the implementation of the process described above.

Provision is thus made for the installation of the invention to comprise, as means for cooling the vapour fraction obtained at the outlet of the said first separating unit, before the entry of this vapour fraction into the final compression stage, second heat exchange means where this vapour fraction is placed in a heat exchange with the refrigerating fluid mentioned above.

This characteristic and others appear in claims 19 to 30 hereinafter.

A more detailed description of the invention will now be given with reference to the accompanying drawings, in which:

FIGS. 1, 2, 3, 4, 5, 6 and 7 show as many possible embodiments of the installation of the invention as there are figures.

The installation for the liquefaction of natural gas shown in the figures, and especially in FIG. 1, comprises in particular a cycle compression unit 1 with two compress-ion stages 1A, 1C, each stage delivering by way of a pipe 2A, 2C into a condenser or cooler, respectively 3A, 3C, cooled by water or air, the fluid available which is used typically having a temperature of the order of +25° C. to +35° C.; separating means identified as a whole by 4, interposed between the two compression stages 1A and 1C so as to supply the high pressure stage 1C with a vapour fraction derived from these separating means; a first heat exchange unit 5 comprising two heat exchangers in series, that is to say, a "hot" exchanger 6 and a "cold" exchanger 7; an intermediate separating pot 8; and a store for liquefied natural gas (GNL) 10.

The separating means 4 may be constituted either by a distillation apparatus 12, the upper head part 12*a* of which is cooled by a liquid coming from a separator 13 (FIGS. 1 to 5 and 7), or by two separating pots 14, 15, the vapour fraction of the distillation apparatus 12 or of the first separator 14 circulating in the associated separator (respectively 13, 15) before being admitted at the inlet of the high pressure compression stage 1C.

Assuming that a distillation column 12 is used, the outlet of the condenser 3A communicates with the lower part of the vessel 12*b* of the distillation column 12, and the lower part of the separator 13 is connected by gravity or by a pump, by way of a siphon 16 and a regulating valve 17, to the head 12*a* of the column 12.

According to an important characteristic of the invention, the installation for the liquefaction of natural gas additionally comprises, in the different embodiments in FIGS. 1 to 7, a second heat exchange unit 18 constituting a second refrigerating group, independent of the first, 5.

Figure 2:
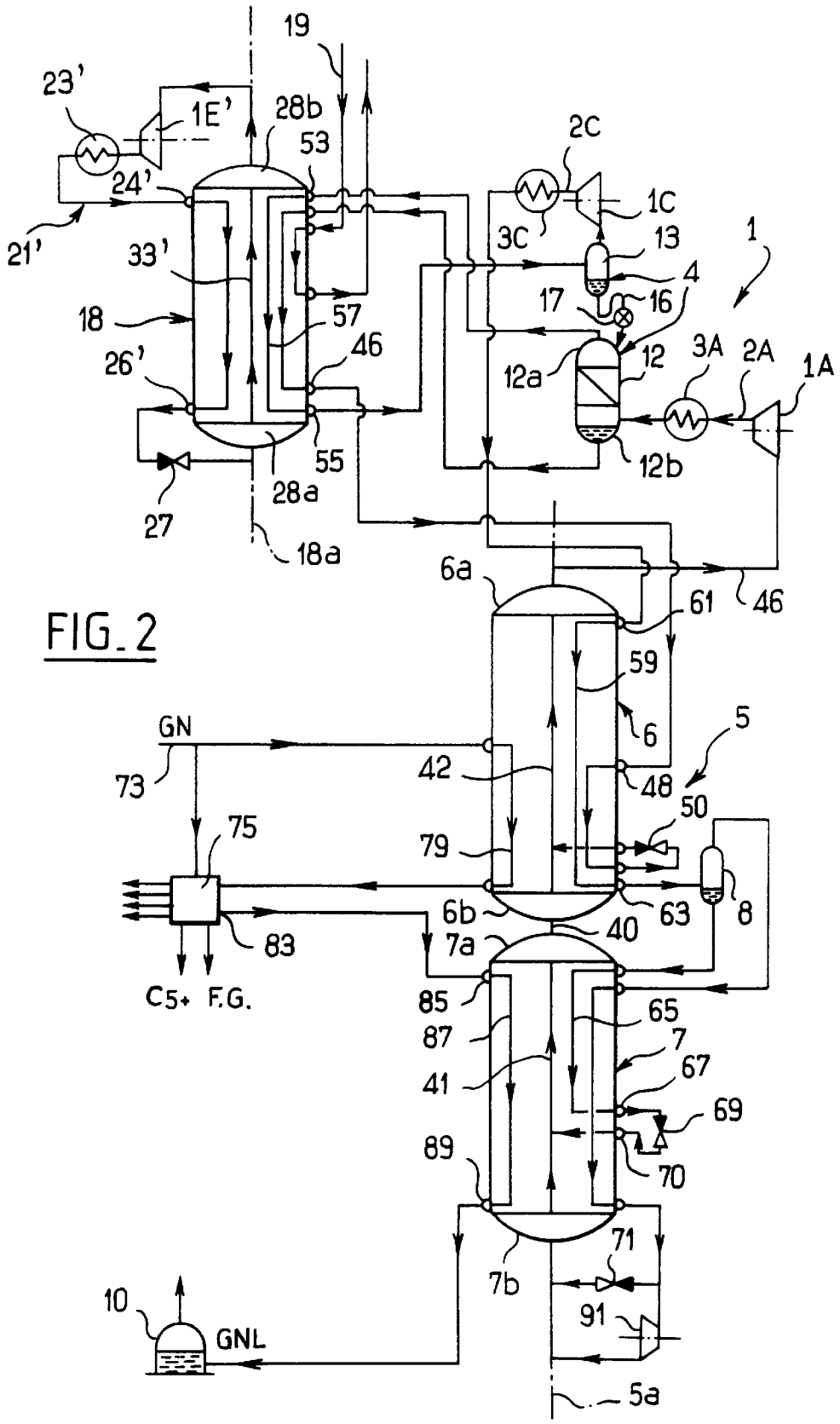
Figure 3:
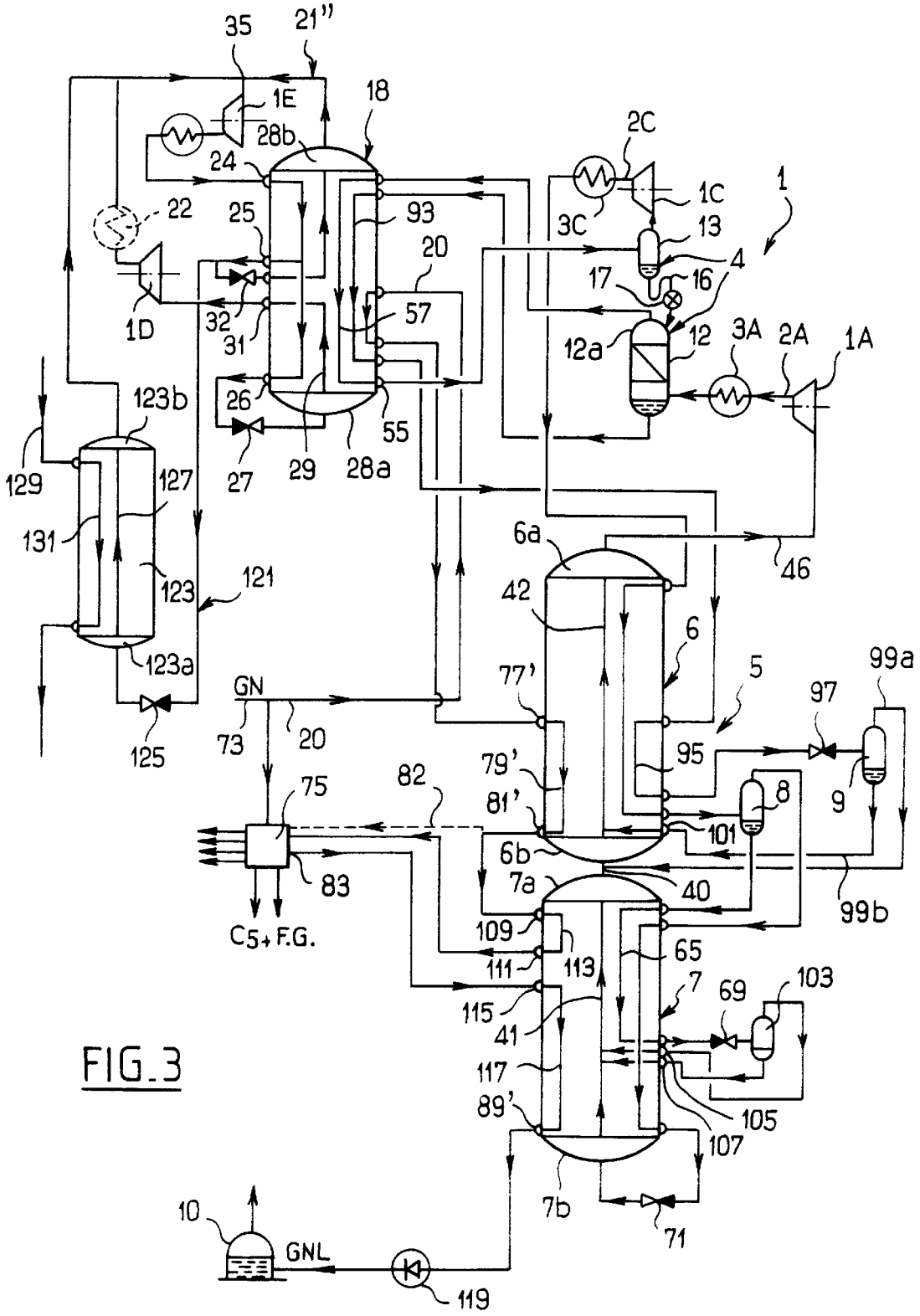

This second refrigerating group has in particular the function, in combination or alternatively:

- of cooling the vapour fraction derived from the first separating means 12 or 14, before it passes into the second separating means 13, 15,
- of cooling the liquid fraction derived from the said first separating means 12, 14, before sending it into the first, 6, of the two exchangers of the first heat exchange unit 5,
- of effecting the cooling of an auxiliary circuit 19 (FIGS. 1, 2 and 4 to 7) in which circulates either pentane, or natural gas before decarbonation and drying (that is to say, relatively moist),
- or even, by means of the circuit 20 in FIG. 3, of cooling natural gas which is already dry but not yet fractionated, before sending it into the first heat exchange unit 5 in order to liquefy it, with the intermediate elimination of C2+ hydrocarbons, in the fractionating unit 75.

With regard to the auxiliary circuit 19, it may pass into the hottest part of the exchanger 18 which is then used to cool from around +40° C. to +20° C. the heat-exchanging fluid which circulates therein, the fluid (if it is not natural gas) being able to serve to refrigerate another part of the installation, for example crude natural gas intended to be dried before its treatment in the installation.

In the heat exchanger 18, the fluid circulating in each of the aforesaid cooling circuits is cooled by indirect heat exchange with a refrigerating fluid, such as a "pure" fluid, or binary or ternary mixture, circulating in a closed circuit in the regenerating cycle 21 or 21'.

In FIGS. 1, 3, 4, 5 and 7, the regenerating circuit 21 is in the form of a refrigeration cycle with two compression stages, comprising a low pressure stage 1D (of the order of 2.5 to 3.5 bar) and a high pressure compression stage 1E (functioning at approximately 6 to 8 bar), optionally a cooler 22, and a condenser 23 condensing the circulating mixture.

This mixture may in particular comprise approximately 60% of butane and approximately 40% of propane. A "pure" fluid may however be used as an alternative.

The mixture which leaves the high pressure stage 1E is totally condensed in the condenser 23, so that it is a liquid mixture which is admitted to the hot upper end (approximately 40° C.) of the exchanger 18.

Substantially half-way along the axial length (axis 18*a*) of the exchanger, a part of the mixture cooled to around 20° C. has emerged at 25, while the remaining part continues to circulate as far as the lower, cold end of the exchanger, in order to emerge at 26 at around 8° C. and to be pressure-relieved at 27 to the low pressure of the cycle before being reintroduced axially through the lower, cold dome 28*a* of the exchanger into passages 29 where the low pressure liquid mixture is vaporised before emerging laterally at 31 substantially half-way along the axial length of the exchanger and being admitted into the low pressure stage 1D.

On leaving the compression stage 1D, the refrigerating mixture, in the gaseous state, may be cooled in the cooler 22, before being admitted at the inlet of the high pressure stage 1E, in admixture with the part of the binary mixture which was recovered at 25, relieved to an intermediate cycle pressure at 32, reintroduced into the exchanger 18 for axial circulation over approximately half the length of the exchanger, so as to be vaporised in the axial passages 33, the vaporised mixture emerging axially through the "hot" upper dome 28*b* before being therefore mixed at 35 with the part of the mixture in the gaseous state derived from stage 1D.

The exchangers 6, 7 and 18 are preferably plate exchangers, the plates preferably being equipped with fins (or waves). These exchangers, which are metallic, may, for example, have plates and fins made of aluminium.

Specifically concerning the two exchangers 6, 7, they may be brazed or welded coaxially end to end, in series, for counter-flow circulation of the fluids placed in a heat exchange relationship, and may be of the same length.

They additionally have passages between the plates, necessary for the functioning which will be described hereinafter.

Before that, it will however be noted that at the site of the end to end joint 40 "on domes" between the "cold" exchanger 7 and the "hot" exchanger 6, the return passages, 41 for the exchanger 7 and 42 for the exchanger 6 (in which the refrigerating mixture circulates in a counter-flow to the circulation in the other passages of these exchangers) communicate directly with one another in the intermediate region 40, as had already been provided for in WO-A-94 24500.

It should be noted that such a direct passage at 40 between the upper dome 7*a* of the exchanger 7 and the lower dome 6*b* of the exchanger 6, over at least the essential part of the section of the two exchangers, can be produced only by avoiding a diphase redistribution at the cut-off 40, as moreover in WO-A-94 24500.

With an installation as described above, the refriger-ating mixture consisting of C1 to C6 hydrocarbons and of nitrogen emerges in a gaseous state from the top 6*a* (termed the "hot" end) of the exchanger 6 (by way of the passages 42) and passes by way of the recycling pipe 46 to the intake of the first compression stage 1A.

This gaseous mixture is then compressed to a first intermediate pressure $P_i$, typically of the order of 12 to 20 bar, then is cooled to around +30° C. to +40° C. at 3A, with partial condensation, and separated into a vapour fraction and a liquid fraction in the distillation apparatus 12.

The vessel liquid of the column 12 (recovered at 12*b*) constitutes a first refrigerating liquid arranged to provide the essential part of the refrigeration of the hot exchanger 6, after cooling in the exchanger 18.

For that, the vessel liquid is admitted (at around 30° C. to 40° C.) towards the "hot" end 28*b* of the exchanger 18 in which it circulates, as far as its "cold" end 28*a*, to emerge at 47 at around 8° C., this cooled liquid fraction then being introduced substantially at the same temperature at the location of an intermediate lateral inlet 48, substantially half-way along the hot exchanger 6, to emerge again laterally towards its "cold" end 6*b*, at around −20° C. to −40° C., and to be relieved (or undergo expansion) to the low pressure of the cycle (2.5 to 3.5 bar) in a pressure reducing valve 50 and to be reintroduced in diphase form, still at the cold end 6*b* of the same exchanger, by way of the lateral inlet box 52 and a suitable distribution device, in order to be vaporised in the low pressure passages 42 of the exchanger.

As to the head vapour of the distillation column 12, recovered on emerging from the head 12*a*, this circulates, as illustrated in FIGS. 1 to 5 and 7, substantially between the hot end 28*b* and cold end 28*a* of the exchanger 18, with entry and exit towards the two ends at 53 and 55 respectively, so as to be cooled and partially condensed in the passages 57 of the exchanger to an intermediate temperature lower than the said "ambient" temperature, for example of +5° C. to +10° C., then introduced into the separating pot 13. In practice, the temperature reached may even (optionally) be lower than the temperature of the "cooling fluid" available on site.

The liquid phase recovered at the base of the separator 13 returns, by way of the siphon 16 and the regulating valve 17, to the head of the column 12 to cool it, while the vapour phase of the separator is compressed to the high pressure of the cycle (of the order of 40 to 45 bar) at 1C, then is brought to around +30° C. to +40° C. in the cooler 3C. In this case, the temperature of the head of the column 12 will therefore be lower than the said "ambient" temperature, or even the temperature of the "cooling fluid" available on site, even if it could have been imagined that this temperature might be higher, in particular by omitting the cooler 3A and functioning as in EP-A-117 793, that is to say, with a passage directly from the compression stage 1A to the entry into the distilling means 12.

This high pressure vapour fraction cooled in the refrigerating device 3C substantially as far as the temperature termed "ambient" (except for the temperature deviation fixed in the definition on page 2), is then cooled again from the hot end 6*a* towards the cold end 6*b* (therefore from around 30° C. to −30° C.) in the high pressure passages 59 of the exchanger 6, with entry and exit respectively at 61 and 63, then separated into liquid and vapour fractions at 8.

It should be noted that controlling the temperature and the pressure (+5° C. to +10° C., 12 to 20 bar) of the liquid for cooling the head of the column 12 makes it possible to obtain a monophase gas both on emerging from 3C and at 40, justemerging from the exchanger 7.

This cold exchanger 7 is refrigerated by means of the high pressure fluid, in the following manner:

The liquid collected at the base of the separator 8 is under-cooled in the hot part of the exchanger 7, in passages 65, is removed from the exchanger in the intermediate part (at 67) at around −120° C., relieved to the low pressure of the cycle, for example in a pressure-reducing valve 69, and reintroduced laterally at 70, still in the intermediate part of the exchanger, in the low pressure return passages 41 of the latter.

As to the vapour fraction derived from the separator 8, this is cooled, condensed and under-cooled (to around −160° C.) from the hot end to the cold end of the exchanger 7 and the liquid thus obtained is relieved to the low pressure of the cycle in a pressure-reducing valve 71 and reintroduced into the exchanger 7, parallel to the axis 5*a*, through the "cold" lower dome 7*b*, in order to be vaporised in the cold part of the low pressure passages 41, then combined with the relieved diphase fluids (essentially liquid) admitted through the intermediate entry 70, for return towards the pipe 46.

The treated natural gas, reaching, for example, a temperature of the order of 20° C. after drying, by way of a pipe 73 is, in part, admitted directly into the apparatus 75 for elimination of C2+ hydrocarbons and, for the remainder, is admitted laterally at 77, substantially half-way along the exchanger 6, in order to be cooled towards the cold end 6*b* in passages 79, before emerging laterally towards that end, at 81, this cooled portion (around −20° C. to −40° C.) then being admitted into the unit 75.

In the unit 75, from the natural gas admitted into it, are extracted:

- the products which would be likely to crystallise during liquefaction (that is to say, essentially the C6+s),
- the C2 to C5 products necessary for maintaining the composition of the cycle gas,
- and optionally the quantities of products to be extracted so that the liquefied natural gas conforms to the specifications required by the users,
- and the major part of the "fuel gas", necessary for the production of mechanical energy of the installation, is produced directly at the required pressure.

The remaining mixture emerging at 83 is then admitted at 85, in proximity to the "hot" dome 7*b* of the "cold" exchanger 7, to circulate to near its cold end 7*b*, in passages 87, while being liquefied and under-cooled in order to emerge at 89, at around −160° C., before being stored, in the form of liquid (GNL), at 10, after having been relieved from pressure.

It should be noted that, preferably, the essential part (approximately 90%) of the decarbonated and dry natural gas (GN) flow admitted by means of the pipe 73 will circulate in the passages 79, only around 10% at most being therefore admitted directly into the separating installation 75.

With such an arrangement and by means, in particular, of the relieving of the exchanger 6 from load obtained compared with what is described in WO-A-94 24500, a saving of around 10% of total energy is provided, as well as unloading of the exchanger 6 of around half of its thermal work, 40 to 50% more natural gas being able to be treated in such an exchanger of defined size.

Figure 4:
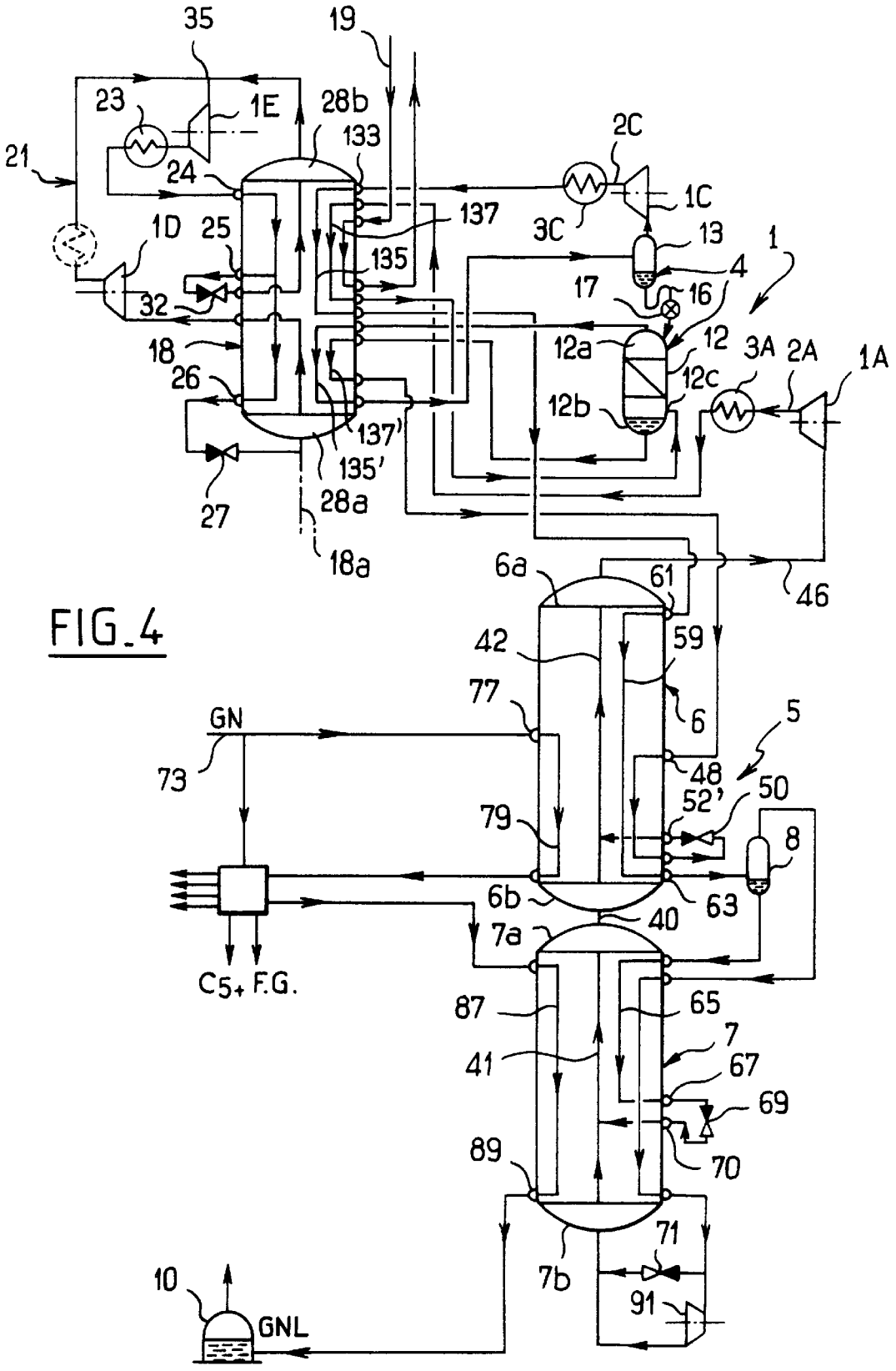

As shown in FIGS. 1, 2 and 4, it may be desirable to relieve a part of the cold liquids in liquid turbines or "expanders" 91 provided in parallel with the pressure-reducing valves 69 and/or 71.

It should be noted that in practice, n exchangers 6 and 7 will be mounted in parallel, as well as n' exchangers 18 also in parallel.

It should further be noted that the expanders provided on the circulation paths of the liquids may in particular be used to drive pumps (not shown), the one which supplies most power being that which is arranged in parallel with the valve 69, the valves preferably serving only for fine adjustment or for relief from pressure (expansion) of the liquid under consideration, in the event of failure of the corresponding (turbo-)expander.

In FIG. 2, the elements common to FIG. 1 have been identified in the same manner (similarly for the other figures).

The principal difference between FIGS. 1 and 2 consists in the arrangement of the closed circuit 21' of the refrigerating liquid, circulating in the second heat exchange unit 18.

In fact, in FIG. 2, it is a question of a cycle with one compression stage 1E', therefore comprising a single high pressure compressor (of the order of 6.5 to 7.5 bar).

In the circuit 21' there will preferably circulate a ternary mixture, for example composed of ethane, butane and propane.

On emerging from the compressor 1E', the mixture in its vapour form is (totally) condensed in the condenser 23' in order to be admitted at 24' towards the hot end 28*b* of the exchanger 18 in which it circulates longitudinally (parallel to the axis 18*a*) as far as the cold end 28*a*, in proximity to which it emerges laterally at 26' at around 8° C. to 10° C. in order to be relieved by the valve 27 to around 2.5 to 3.5 bar.

The refrigerating mixture thus cooled and pressure-relieved is then re-injected through the cold dome 28*a*, parallel to the axis 18*a*, in a counter-flow to the other circulation passages, in the vaporisation passages 33' in order to emerge coaxially through the "hot" dome 28*b* and to be introduced, still in its vapour form, at around 30° C. to 40° C. at the entry of the compressor 1E'.

It should be noted that the use of a ternary mixture makes it possible to obtain a greater temperature gradient than the binary mixture used in the circuit 21 in FIGS. 1, 4, 5 and 7.

Figure 6:
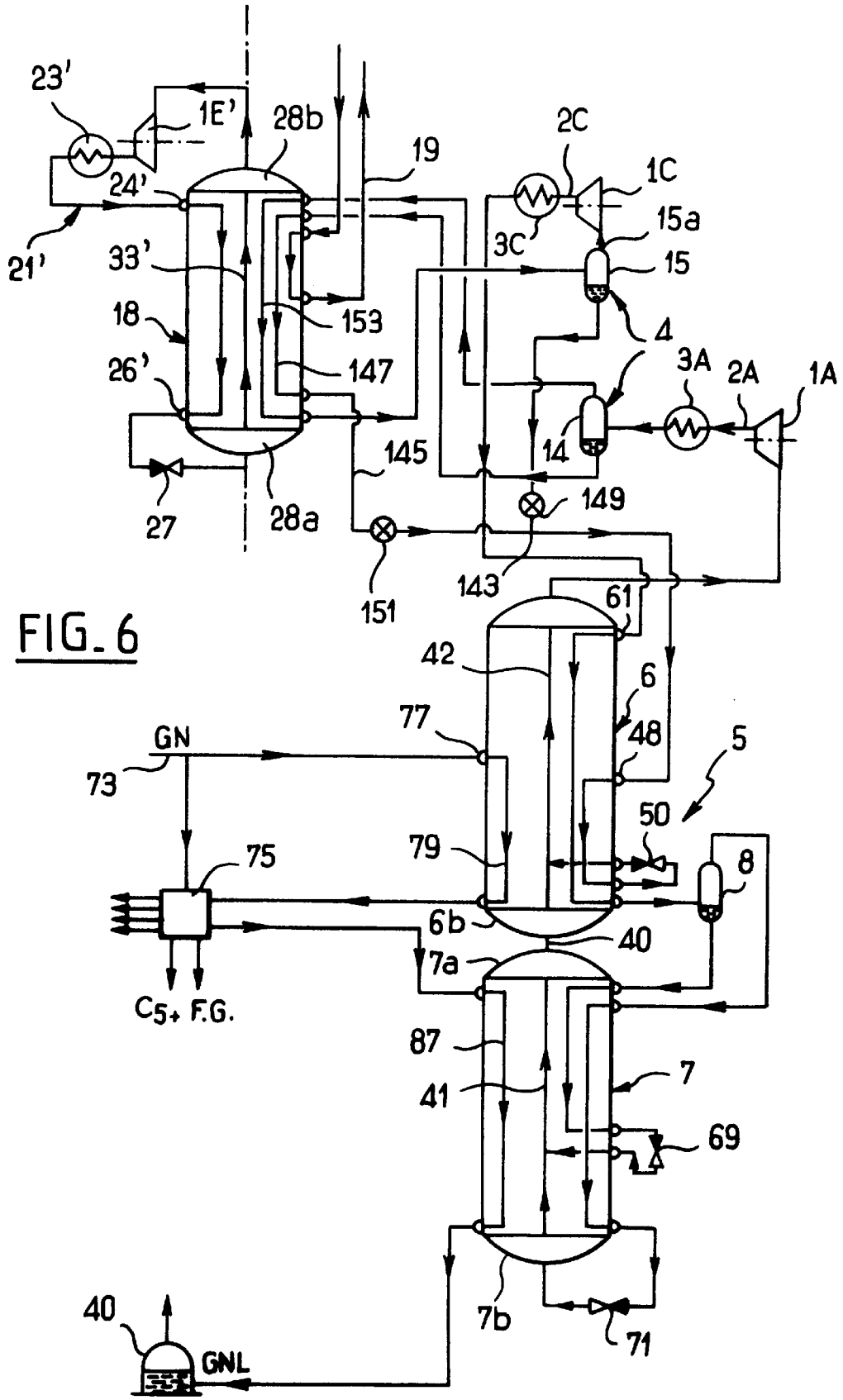

The circuit 21', which is also found in FIG. 6, is simpler than the circuit 21 but has an energy handicap of around 15 to 20% compared with that circuit, or around 1.5 to 2% over the complete cycle of the installation.

In FIG. 3, the refrigerating cycle mixture of the installation, in its liquid fraction derived from the vessel liquid of the distillation apparatus 12, after being cooled substantially between the hot end 28*b* and the cold end 28*a* of the exchanger 18 in the corresponding passages 93, then under-cooling in a cold part of the "hot" exchanger 6 in the passages 95 of this exchanger, undergoes expansion in an expansion valve 97, before being sent into the separator 9.

The gaseous fraction (by way of 99*a*) and liquid fraction (by way of 99*b*) are then injected separately into the return passages of the cycle, with low pressure vaporisation.

More precisely, the vapour fraction is injected laterally at the site of the cut-off off 40, while the liquid fraction is injected slightly further downstream, in proximity to the cold end 6*b* of the exchanger 6, by way of the lateral injection path 101 opening out at 42.

A comparable treatment of the liquid fraction derived from the cycle separator 8 and pressure-relieved in the expansion valve 69 after having circulated in the passages 65, in order to be under-cooled, is carried out in the third cycle separator 103.

Thus, the fractions, respectively gaseous and liquid, derived from this separator are injected separately through separate injection points, respectively 105 and 107, substantially at the same intermediate level of the cold vaporisation passages 41 of the exchanger 7, that is to say, therefore, further upstream of the return passages of the refrigerating mixture vaporised at low pressure than the injection arrival points of the vapour and liquid fractions arriving from 99*a* and 99*b*.

Still in FIG. 3, it will be noted that the natural gas (GN), after decarbonation and drying, is admitted for the major part (around 90%) at 77', in the intermediate part of the exchanger 6, after having circulated in the pipes 20 in a heat exchange in the exchanger 18, in order to be cooled therein by indirect heat exchange with the refrigerating liquid in circulation in the circuit 21" which will be described hereinafter.

After having circulated in the passages 79' as far as the cold end 6*b* of the exchanger 6, the natural gas thus under-cooled emerges at 81' from the exchanger 6 in order to pass into the exchanger 7, by way of an injection point 109, before emerging through an intermediate outlet 111, after being under-cooled in the passages 113, to a temperature of around +40° C. to +60° C., the gas thus under-cooled passing into the separating installation 75, its fraction which emerges at 83 being then re-injected laterally at 115 in the intermediate part of the exchanger 7 in order to circulate in the cold passages 117 to around +160° C. and thus to be liquefied, before emerging at 89', substantially at the location of the outlet 89 of the pre-ceding figures, to pass then into the expansion valve 119 (which could also be an expander) and finally to be stored in the storage unit 10 after being pressure-relieved.

It should be noted that at the outlet 81', a part of the gas may be delivered into the separating unit 75, by way of the pipe 82, without passing thereto through the exchanger 7.

If consideration is now given to the circuit 21" of the refrigerating fluid used in the exchanger 18, it will be noted that in addition to the circuit 21 in FIG. 1 (the characteristics of which it also has) the circuit 21" comprises an additional circuit 121, connected in parallel, at entry, between the outlet 25 and the expansion valve 32 and, at exit, between the condenser 22 (or the outlet of the low pressure condenser 1D) and the mixture connection 35.

The circuit 121 thus connected comprises an additional exchanger 123 in which there circulates, between its cold end 123*a* and its hotter end 123*b*, the liquefied binary refrigerating mixture emerging from 25 and relieved in 125 in an expansion valve, before being vaporised in the passages 127, between the cold and hot ends of the exchanger 123, in a counter-flow to a flow of relatively moist natural gas (before drying), admitted at 129 and therefore circulating in the opposite direction to the fluid vaporised in 127, inside the passages 131, before being introduced into a drying unit (not shown), then optionally being introduced at the inlet "GN" 73 in order to leave either in the pipe 20, or directly towards the separating installation 75.

The installation in FIG. 4 thus differs from that in FIG. 1 only:

- by the fact of the circulation of the high pressure vapour fraction emerging from 3C, before this vapour fraction reaches the lateral injection inlet 61 of the exchanger 6,
- and in the manner in which the compressed refrigerating mixture emerging from the condenser 3A is admitted into the distilling means 12, owing to the fact that cooling of the mixture emerging from 3A is provided below the "ambient" temperature (and even, optionally, below the temperature of the cooling fluid available on site) before entry into the column 12, by circulation in the exchanger 18.

In FIG. 4 it will thus be noted that on emerging from the cooler 3C, the high pressure vapour fraction is admitted at 133 towards the "hot" end 28*a* of the exchanger 18 in order to be cooled as far as an intermediate region of the axial length of the exchanger, before emerging therefrom in order to be admitted into the exchanger 6, by way of the injection inlet 61.

The passages left free following those 135 reserved for the said high pressure vapour fraction in the exchanger 18, are here used to condense the vapour fraction derived from the head 12*a* of the distillation column 12 (vaporisation passages indicated by 135') before this condensed vapour fraction is separated at 13.

Partition of the lengths of the passages has also been used to cool, in the least cold part of the exchanger 18 (passages 137), the compressed diphase mixture emerging from the condenser 3A, before admitting it into the low inlet 12*c* of the distillation apparatus 12 (at around 10° C. to 15° C. below the "ambient" temperature), the complementary part of the passages 137 (indicated by 137') located in the coldest part of the exchanger 18 serving to cool the vessel liquid recovered at 12*b*, before admitting it into the lateral injection inlet 48 of the exchanger 6.

It should be noted that the circulation in the passages 137 of the partially condensed and compressed diphase mixture makes it possible to obtain a temperature at entry into the first part 12 of the separating means 4 which may therefore be different from (lower than) the "ambient temperature", or even the temperature of the cooling fluid available on site.

This cooling of the vessel temperature of the distilling means 12 makes it possible to attain a cut-off temperature (at 40) which is lower than in the other cases.

It should also be noted that the circulation of the high pressure vapour fraction in the passages 135 makes it possible to obtain at 61 a temperature at entry of this vapour fraction into the exchanger 6 of the order of 25° C. to 30° C. which can be adapted and which may, in particular, be lower than the temperature at entry at 61 of the installation in FIG. 1, typically of the order of 40° C., that is to say, close to the temperature termed "ambient" (or the temperature of the "cooling fluid").

Even if that has not been illustrated, the intermed-iate cooling, in the passages 137, of the partially condensed and compressed diphase mixture, between the condenser 3A and the first unit (12 or 14) of the separating means 4, could be provided in the installation with two associated separators 14, 15 of FIG. 6.

Figure 5:
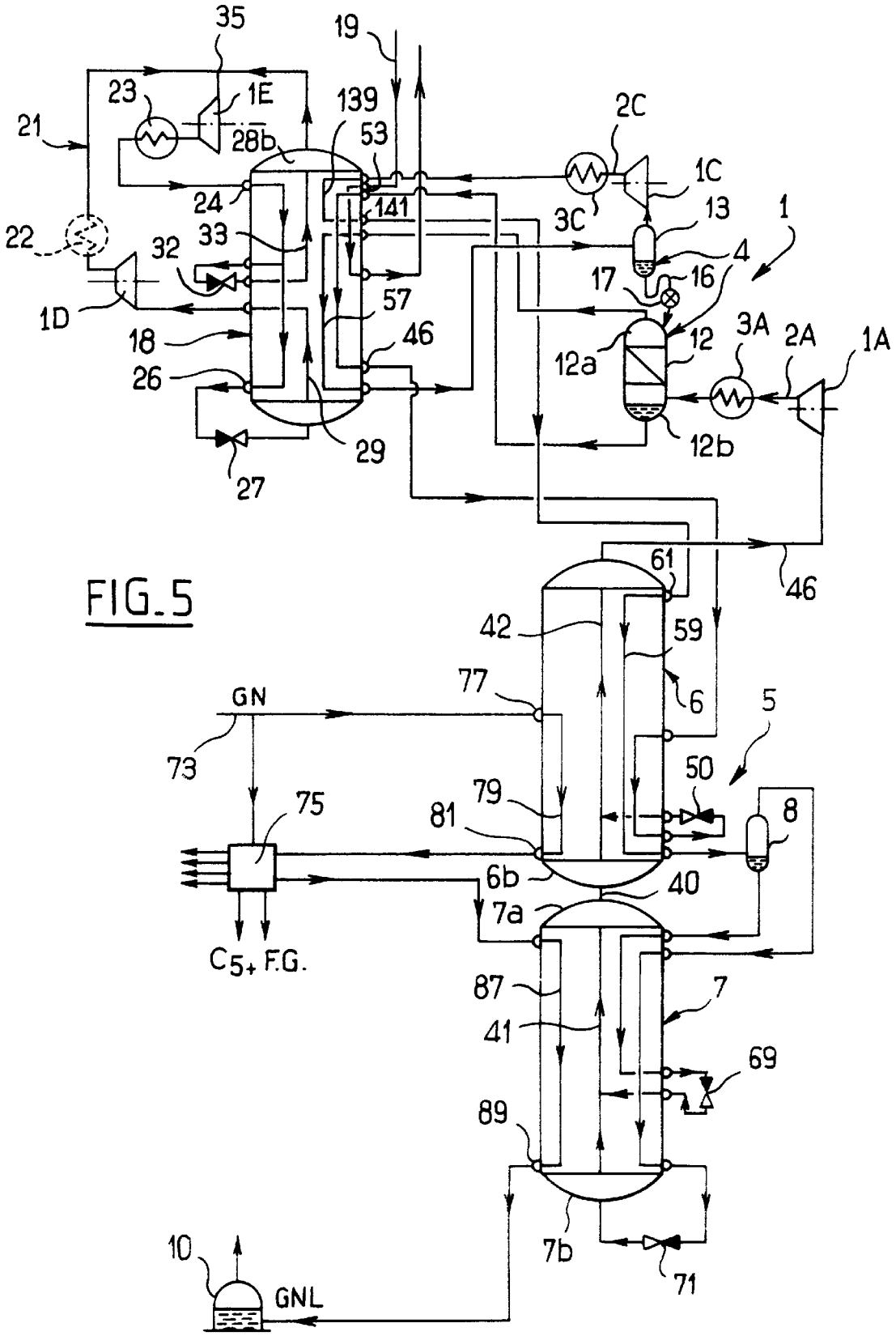

But before returning to this solution in FIG. 6, it is pointed out that in FIG. 5 the high pressure cycle gas passing into 2C and optionally partially condensed at 3C is cooled by around ten degrees (that is to say, typically from around 40° C. to around 30° C.) in passages 139 of the exchanger 18 which are located on the same side as the "hot" dome 28*b* of the after, before emerging laterally at 141, then being injected as before at 61 into the exchanger 6.

The interest of such cooling which can be controlled by adapting the functioning of the exchanger 18, is to achieve between the inlet 61 and the recycling pipe 46, a temperature deviation of less than approximately 20° C., and therefore to obtain an exit from the cooling cycle at around 20° C., fairly close to the dew point of the refriger-ating mixture used, this cooling of only about 10° C. in the passages 139 avoiding liquefying the high pressure vapour phase before injecting it at 61.

From the energy point of view, this version of FIG. 5 appears potentially one of the most interesting.

With regard to the other characteristics, the installation in FIG. 5 corresponds to that in FIG. 1 (the provision of an expander 91 in parallel with the pressure-reducing valve 69 being optional).

In FIG. 6, the distillation column 12 has therefore been replaced by a separator 14.

The liquid fraction recovered at around 8° C. in the lower part of the second separator 15 is transmitted towards the intermediate inlet 48, a priori directly, without passing through the exchanger 18.

At 143, this liquid fraction derived from the separator 15 meets the pipe 145 used for the liquid fraction recovered from the separator 14, after circulation substantially between the "hot" end 28*b* and "cold" end 28*a* of the exchanger 18, in the indirect cooling passages 147.

Regulating valves, respectively 149 and 151, make it possible to adapt the flow rate of the liquid fractions derived from the separators 14 and 15, respectively.

The circulation of the liquid fraction from the separator 14 in the passages 147 makes it possible to bring its temperature from around 40° C. to around 8° C., at which temperature the liquid fraction of the separator 15 is recovered, owing to its circulation in the passages 153 of the exchanger 15 is recovered, owing to its conditions of indirect heat exchange as the liquid fraction circulating in the passages 147.

Taking this into account, and as has already been indicated, the vapour fraction having circulated in the passages 153 in a counter-flow (as for 147 in particular) to the passages 133' of the cooling circuit 21', is condensed so as to be introduced in this form into the separator 15, the vapour fraction recovered at 15*a* being itself admitted at the inlet of the high pressure compressor 1C.

Taking account of the above, it will have been understood that the "liquid" entry of the exchanger 6, at 48, takes place at around 8° C. in the installation in FIG. 6.

Figure 7:
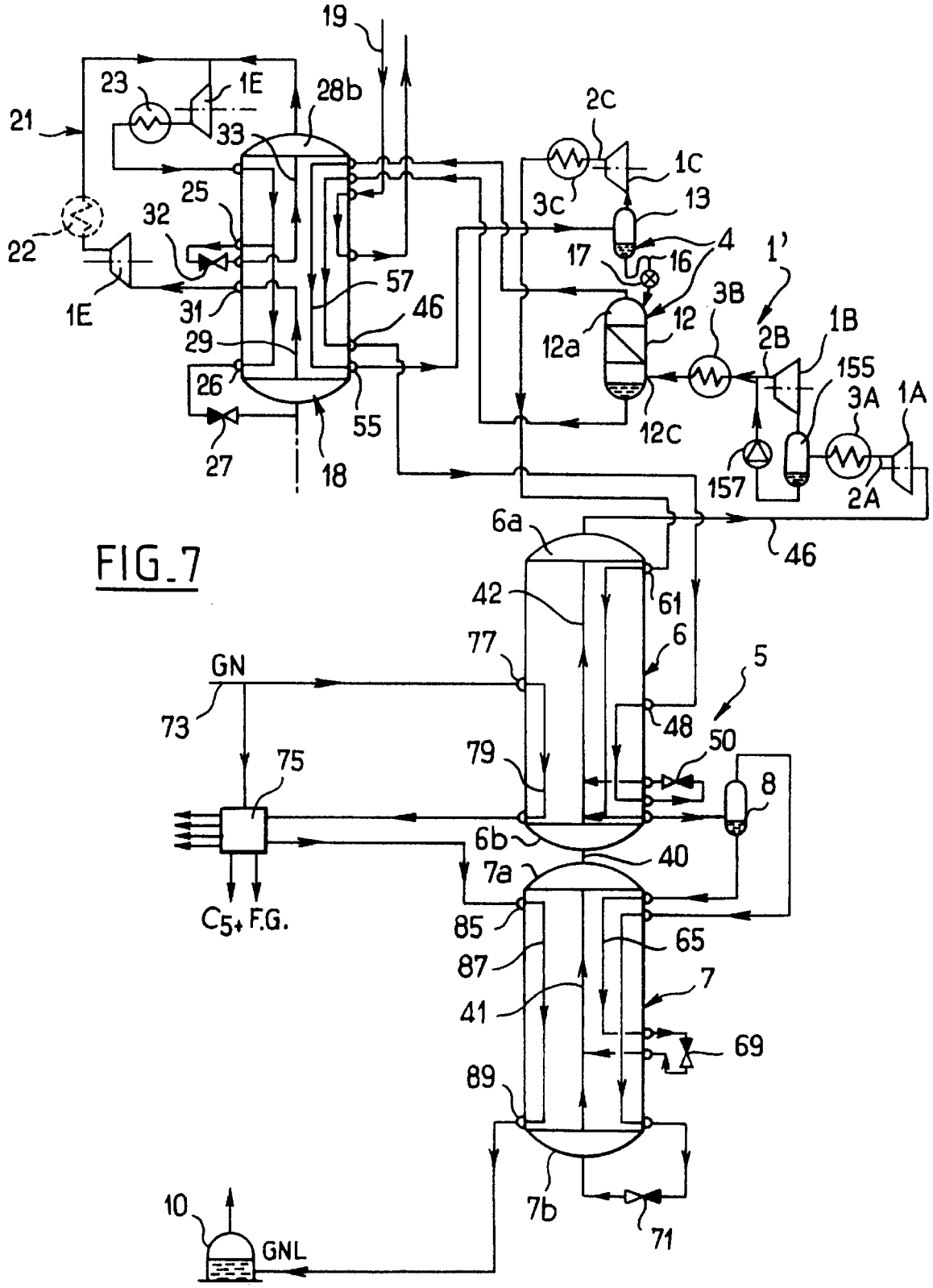

The installation in FIG. 7 differs from that in FIG. 1 only (if the provision of the expander 91 in parallel with the pressure-reducing valve 69 is excepted) by the fact that not two but three compression stages are provided in the cycle compression unit 1'.

Thus in this FIG. 7, between the inlet 12*c* of the distillation apparatus 12 and the outlet of the condenser 3A, there have been interposed a separator 155, a pump 157, and an intermediate compression stage 1B delivering at 2B into a condenser 3B, the outlet of which communicates with the inlet 12*c* of the distillation apparatus 12.

As has already been described in WO-A-94 24500, this intermediate compression stage and its accessories make it possible to separate, at 155, into a vapour fraction and a liquid fraction, the refrigerating mixture compressed at 1A and partially condensed at 3A, with cooling to a temperature of +30° C. to +40° C.

The vapour phase derived from the separator 155 is compressed to a second intermediate pressure $P_i$, typically of the order of 12 to 20 bar, at 1B, while the liquid fraction recovered from the same separator 155 is brought by the pump 157 to the same pressure $P_i$ and injected into the pipe 2B (or optionally at the outlet of the partial condenser 3B).

The mixture of the two phases in this pipe is then cooled and partially condensed at 3B, then distilled at 12.

It should be noted that such a compression unit 1' with three compression stages could be used in the other versions of the installation of the invention.

Moreover, and more generally, the particular features of one figure may be applied, in the present case, to any other, indifferently.

With regard to the use of the separators 9 and 103, this could likewise be applied in the case of any other figure.

Similarly, the circulation of the natural gas in the passages 79' then 113 may be provided in figures other than FIG. 3, in as far as the temperature at dispatch to the unit 75 is different from the temperature at the cut-off at 40.

I claim:

1. A process for cooling a fluid, comprising:

a) compressing a refrigerating mixture in a penultimate stage of a plurality of stages of a compression unit, b) partially condensing the mixture by cooling to produce a condensed mixture, c) separating the condensed mixture to produce a vapour fraction and a liquid fraction, d) cooling and partially condensing the vapour fraction to produce a cooled, partially condensed, resultant vapour fraction, e) compressing the cooled, partially condensed, resultant vapour fraction in a final compression stage of said compression unit to produce a high pressure vapour fraction, f) cooling, expanding, and circulating at least certain of the high pressure vapour fraction and the liquid fraction in at least first heat exchange means in cooling relationship with the fluid to be cooled, wherein during step d) the vapour fraction produced in step c) is cooled by being circulated in second heat exchange means in heat-exchanging relationship with a refrigerating fluid.

2. The process according to claim 1, wherein during steps c), d), and e)

the condensed mixture is separated in a first separator, which produces said vapour fraction and said liquid fraction, the vapour fraction produced by the first separator is condensed in the second heat exchange means to produce a condensed vapour fraction, the condensed vapour fraction is separated in a second separator, which produces said resultant vapour fraction and a resultant liquid fraction, and the resultant liquid fraction produced by the second separator is fed into said first heat exchange means.

3. The process according to claim 2, wherein the liquid fraction produced by the first separator is passed through the second heat exchange means, and before the resultant liquid fraction produced by the second separator is fed into the first heat exchange means, it is combined with the liquid fraction produced by the first separator means after the liquid fraction produced by the first separator has passed through said second heat exchange means.

4. The process according to claim 1, wherein during steps c), d), and e)

the condensed mixture is separated in a first separating means, which produces said vapour fraction and said liquid fraction, the vapour fraction produced by the first separating means is condensed in said second heat exchange means to produce a condensed vapour fraction, the condensed vapour fraction is separated in a second separating means to produce said resultant vapour fraction and a resultant liquid fraction, and the resultant liquid fraction produced by the second separating means is returned to the first separating means to cool it.

5. The process according to claim 2, wherein the liquid fraction produced by the first separator is circulated in said second heat exchange means before being fed into the first heat exchange means.

6. The process according to claim 5, wherein said first heat exchange means comprises a first, hot heat exchanger and a second, cold heat exchanger arranged in series, said liquid fraction produced by the first separator is circulated in the second heat exchange means, between a hot end and a cold end thereof, to produce a cooled liquid fraction, and the cooled liquid fraction is fed into an intermediate part of said first, hot heat exchanger.

7. The process according to claim 1, comprising circulating the refrigerating fluid in a closed circuit refrigeration cycle having two successive compression stages to produce a compressed refrigerating fluid, and totally condensing the compressed refrigerating fluid.

8. The process according to claim 1, comprising circulating the refrigerating fluid in a closed circuit refrigeration cycle having a single compression stage to produce a compressed refrigerating fluid, and totally condensing the compressed refrigerating fluid.

9. The process according to claim 1, wherein during step f)

the high pressure vapour fraction produced by the final compression stage of said compression unit is cooled to produce a cooled vapour fraction, and the cooled vapour fraction is circulated in the second heat exchange means, to cool it further by heat exchange with the refrigerating fluid, before being fed into the first heat exchange means.

10. The process according to claim 4, wherein to cool further the high pressure vapour fraction, it is circulated between a hot end of said second heat exchange means and an intermediate part thereof, and the vapour fraction produced by the first separating means is circulated substantially between said intermediate part and a cold end of said second heat exchange means before being fed into said second separating means.

11. The process according to claim 4, wherein the vapour fraction and the liquid fraction produced by the first separating means are circulated between a hot end and a cold end of the second heat exchange means before being fed, respectively, into said second separating means and into said first heat exchange means.

12. The process according to claim 1 wherein, between the steps b) and c), the condensed mixture is circulated in the second heat exchange means.

13. The process according to claim 1, wherein the fluid to be cooled is natural gas, said first heat exchange means comprises a first, hot heat exchanger and a second, cold heat exchanger arranged in series, before the natural gas is circulated in the first heat exchange means, it is subjected to drying to produce a dried natural gas, and after drying, the dried natural gas passes through a first part of said first, hot, heat exchanger and then through a part of said second, cold heat exchanger before passing into a fractionating unit disposed outside the first heat exchange means.

14. The process according to claim 1, wherein the fluid to be cooled is natural gas, and before the natural gas is admitted into said first heat exchange means, it is passed successively through third heat exchange means to be cooled by heat exchange with said refrigerating fluid, then through an intermediate drying unit, which produces dried natural gas.

15. The process according to claim 14, wherein the dried natural gas produced by the intermediate drying unit is circulated through the second heat exchange means before being fed into the first heat exchange means.

16. The process according to claim 1, wherein the fluid to be cooled is natural gas, before being fed into the first heat exchange means, the natural gas is circulated through the second heat exchange means, and before the natural gas is circulated through the second heat exchange means, it is subjected to drying.

17. The process according to claim 1, wherein the fluid to be cooled is natural gas, said first heat exchange means comprises a first, hot heat exchanger and a second, cold heat exchanger arranged in series, the natural gas is subjected to drying, to produce a dried natural gas, before it is fed into said first, hot heat exchanger to be cooled, at least part of said dried natural gas is cooled in a first part of the second, cold heat exchanger and is then passed into a fractionating unit to produce a fractionated resultant compound, and said fractionated resultant compound is circulated in a second part of the second, cold heat exchanger to be liquefied and under-cooled.

18. The process according to claim 1, wherein the fluid to be cooled is natural gas to be liquefied.

19. The process according to claim 4, wherein the liquid fraction produced by the first separating means is circulated through said second heat exchange means before being fed into the first heat exchange means.

20. The process according to claim 19, wherein said first heat exchange means comprises a first, hot heat exchanger and a second, cold heat exchanger arranged in series, the liquid fraction produced by the first separating means is circulated through the second heat exchange means, between a hot end and a cold end thereof, to produce a cooled liquid fraction, and said cooled liquid fraction is fed into an intermediate part of said first, hot heat exchanger.

21. The process according to claim 1, wherein the fluid to be cooled is natural gas, before being fed into the first heat exchange means, the natural gas is circulated through the second heat exchange means, and, after being circulated through the second heat exchange means, the natural gas is subjected to drying.

22. The process according to claim 4, wherein the first separating means comprises a distillation apparatus.

23. A process for cooling a fluid, comprising:

a) compressing a refrigerating mixture in a penultimate stage of a plurality of stages of a compression unit to produce a compressed mixture, b) separating the compressed mixture to produce a vapour fraction and a liquid fraction, c) cooling and partially condensing said vapour fraction to produce a cooled, partially condensed, resultant vapour fraction, d) compressing the resultant vapour fraction in a final compression stage of said compression unit to produce a high pressure vapour fraction, e) cooling, expanding, and circulating at least certain of said high pressure vapour fraction and said liquid fraction in at least first heat exchange means in cooling relationship with the fluid to be cooled, wherein during step c) said vapour fraction produced in step b) is cooled by being circulated in second heat exchange means in heat-exchanging relationship with a refrigerating fluid.

24. A cooling installation for cooling a fluid, the installation comprising:

a compression unit for compressing at least part of a refrigerating mixture, said compression unit comprising a plurality of compression stages arranged in series and including a final compression stage and a penultimate compression stage, separating means disposed between the penultimate compression stage and the final compression stage, for separating compressed refrigerating mixture produced by the penultimate compression stage into a vapour fraction and a liquid fraction, the separating means having a vapour fraction outlet for said vapour fraction and a liquid fraction outlet for said liquid fraction, cooling and condensing means disposed between the vapour fraction outlet of said separating means and an inlet to the final compression stage, said cooling and condensing means cooling and partially condensing the vapour fraction produced by the separating means and providing a cooled, partially condensed vapour fraction to the final compression stage, and first heat exchange means having an outlet in communication with an inlet to the compression unit; an inlet for the fluid to be cooled; an inlet for the liquid fraction in communication with the liquid fraction outlet of said separating means; and an inlet in communication with an outlet from the final compression stage, wherein said cooling and condensing means comprise second heat exchange means which cool the vapour fraction produced by the separator means, by heat exchange with a refrigerating fluid circulating in said second heat exchange means, to produce a cooled vapour fraction.

25. The installation according to claim 24, wherein said separating means are first separating means, the vapour fraction outlet of said first separating means communicates with an inlet to the second heat exchange means, the second heat exchange means have a cooled vapour fraction outlet for said cooled vapour fraction, and the installation further comprises second separating means disposed between the cooled vapour fraction outlet from the second heat exchange means and the inlet to the final compression stage.

26. The installation according to claim 25, wherein the first separating means comprise a separator.

27. The installation according to claim 25, wherein the first separating means comprise a distillation apparatus.

28. The installation according to claim 25, wherein the second separating means comprise a separator.

29. The installation according to claim 24, further comprising a condensor disposed between said penultimate compression stage and said separating means, wherein a communication passageway extending between an outlet from the condenser and an inlet to the separating means passes through the second heat exchange means.

30. The installation according to claim 24, wherein said refrigerating fluid circulates in a refrigeration circuit comprising:

said second heat exchange means, and third heat exchange means in which the refrigerating fluid and the fluid to be cooled pass in heat-exchanging relationship.

31. The installation according to claim 24, wherein a communication passageway extending between the outlet from the final compression stage and the inlet to the first heat exchange means that is in communication therewith passes through the second heat exchange means.

32. The installation according to claim 24, wherein said installation comprises a refrigerating fluid circuit passing through the second heat exchange means.

33. The installation according to claim 24, wherein a communication passageway extending between the liquid fraction outlet of the separating means and the liquid fraction inlet into the first heat exchange means passes through the second heat exchange means.

34. The installation according to claim 24, wherein said installation further comprises means for heat exchange with a cooling fluid disposed between an outlet of said penultimate compression stage and an inlet into the separating means so as to cool the compressed refrigerating mixture produced by the penultimate compression stage before the compressed refrigerating mixture passes into the separating means.

35. A process for cooling a fluid, comprising:

a) compressing a refrigerating mixture in a penultimate stage of a plurality of stages of a compression unit, b) partially condensing the mixture by cooling to produce a condensed mixture, c) separating the condensed mixture to produce a vapour fraction and a liquid fraction, d) cooling and partially condensing said vapour fraction to produce a resultant vapour fraction, e) feeding the resultant vapour fraction to a final compression stage of said plurality of stages to produce a high pressure vapour fraction, f) cooling, expanding, and circulating at least certain of said high pressure vapour fraction and said liquid fraction in at least first heat exchange means in cooling relationship with the fluid to be cooled, wherein during step d) the vapour fraction produced by separating the condensed mixture is cooled by being circulated in heat exchange relationship with a refrigerating fluid in a second heat exchange means, and wherein during steps c), d), and e)

the condensed mixture is separated in a first separating means to produce said liquid fraction and said vapour fraction, the vapour fraction produced by said first separating means is condensed in said second heat exchange means to produce a condensed vapour fraction, the condensed vapour fraction is fed into a second separating means to produce said resultant vapour fraction and a resultant liquid fraction, and the resultant liquid fraction produced by the second separating means is returned to the first separating means.

* * * * *